United States Patent [19]

Wilson

[11] 4,289,576

[45] Sep. 15, 1981

[54] METHOD FOR REMOVING COBALT-CONTAINING DEPOSITS FROM SURFACES

[75] Inventor: John M. Wilson, Duncan, Okla.

[73] Assignee: Halliburton Company, Duncan, Okla.

[21] Appl. No.: 153,668

[22] Filed: May 27, 1980

[51] Int. Cl.[3] ..... C23F 1/00

[52] U.S. Cl. ..... 156/667; 156/637; 156/664; 252/79.2; 252/79.4; 134/3

[58] Field of Search ..... 156/656, 664, 637–639, 156/667; 252/79.1–79.4, 142, 149; 75/105–107, 119; 134/3, 41

[56] References Cited

U.S. PATENT DOCUMENTS

| | | | |
|---|---|---|---|
| 391,373 | 2/1889 | Mosher | 75/105 |
| 731,839 | 6/1903 | Bahn | 75/107 |
| 2,485,529 | 10/1949 | Cardwell et al. | 252/149 |
| 3,367,874 | 2/1968 | Haviland et al. | 252/79.2 |
| 3,542,540 | 11/1970 | Heinen et al. | 75/107 X |
| 4,244,833 | 1/1981 | Tomaszewski | 252/142 X |

*Primary Examiner*—William A. Powell

*Attorney, Agent, or Firm*—Thomas R. Weaver; John H. Tregoning

[57] ABSTRACT

By this invention there is provided a method for dissolving cobalt (II) and cobalt (III) compounds by contacting said compounds with an aqueous acidic solution comprising a compound containing a radical selected from the group consisting of cyano, cyanato, thiocyanato, ferricyano and mixtures thereof.

25 Claims, No Drawings

METHOD FOR REMOVING COBALT-CONTAINING DEPOSITS FROM SURFACES

Cobalt-cemented tungsten carbide is utilized in industry in a variety of applications where a high resistance to wear is required. For example, cobalt-cemented tungsten carbide is used in tools, dyes, wear-resistant parts such as bearings and shafts, and as an abrasive in liquids. Cobalt-cemented tungsten carbide is manufactured by sintering finely divided metallic cobalt (O) with tungsten carbide particles. The cobalt, usually present in small percentages, acts as a binder in the interior of the parts to hold the tungsten carbide particles together. The sintering process, which involves temperatures in the range of from about 1375° C. to about 1600° C., is usually carried out under a reducing atmosphere of hydrogen to avoid oxidation of the metallic cobalt. However, in spite of the use of a reducing atmosphere in the sintering process, and/or as a result of heating during machining after sintering, deposits of cobalt compounds, for example, oxides of cobalt, are sometimes formed on the exterior surfaces of cobalt-cemented tungsten carbide objects. Such surface deposits should be removed from objects, such as bearings, shafts and the like, which require surfaces substantially free of irregularities for proper operation.

The present invention provides methods and compositions for removing deposits of cobalt (II or III) compounds from the exterior surfaces of objects. The methods and compositions are particularly suitable for removing such deposits from the exterior surfaces of cobalt-cemented tungsten carbide objects. The methods and compositions of the present invention are simply and easily used and do not require special equipment and/or complex procedures.

The method of the present invention for removing cobalt-containing deposits from surfaces is comprised of contacting the deposits with the composition of this invention for a period of time sufficient to dissolve the deposits wherein the composition is comprised of an aqueous acidic solution of a water soluble acid and a water soluble salt, the anionic portion of which being selected from the group consisting of cyano ($CN^{-1}$), cyanato ($CNO^{-1}$), thiocyanato ($SCN^{-1}$), ferricyano ($Fe(CN)_6^{-3}$) and mixtures thereof. The cationic portion of the water soluble salt is preferably an alkali metal, an alkaline earth metal, ammonium or mixtures thereof.

Preferred alkali metals useful herein include sodium and potassium and preferred alkaline earth metals useful herein include magnesium and calcium.

Examples of water soluble salts useful herein include sodium, magnesium, potassium, calcium and ammonium cyanide; sodium, magnesium, potassium, calcium and ammonium cyanate, sodium, magnesium, potassium, calcium and ammonium thiocyanate; and sodium, magnesium, potassium, calcium and ammonium ferricyanide. The thiocyanate salts are preferred and ammonium thiocyanate is most preferred.

Various water soluble mineral acids, water soluble organic acids and mixtures of such acids are also utilized in the composition of the present invention. Examples of mineral acids which are particularly suitable are hydrochloric acid, sulfuric acid and nitric acid. Examples of organic acids which can be used are acetic acid and formic acid. Of these, the mineral acids are preferred with hydrochloric acid being the most preferred.

The water soluble salt is present in the composition in an amount in the range of from about 0.005 to about 18 moles per liter of said aqueous acidic solution, and the water soluble acid is present in the composition in an amount in the range of from about 0.005 to about 12 moles per liter of said aqueous acidic solution.

A preferred composition of the present invention is comprised of an aqueous acidic solution of the above water soluble salt and mixtures of such salts present in the composition in an amount in the range of from about 0.5 to about 6.0 moles per liter and the acid is present in the composition in an amount in the range of from about 0.01 to about 6.0 moles per liter.

A still more preferred composition contains in the range of from about 1.0 to about 3.0 moles of salt per liter and in the range of from about 0.05 to about 1.0 moles of acid per liter.

The water soluble salts useful herein which are of particular value are those wherein the anionic portions thereof are thiocyanate, because such salts do not exhibit cyanide toxicity; that is, hydrogen cyanide has not been observed to be produced upon contacting acid. Furthermore, the thiocyanate salts have not been observed to be a source of hydrogen sulfide when used in the method of this invention. In comparison, the cyanide and cyanato salts, when used as disclosed herein, do exhibit cyanide toxicity.

A particularly preferred deposit removing composition of this invention is comprised of an aqueous acidic solution of ammonium thiocyanate, potassium thiocyanate, sodium thiocyanate or mixtures of such salts, most preferably ammonium thiocyanate, present in the composition in an amount of about 2.56 moles per liter and hydrochloric acid present in the composition in an amount of about 0.43 moles per liter.

In carrying out the methods of the present invention using a composition of the type described above, a surface having cobalt-containing deposits thereon is contacted with the composition for a period of time sufficient for the deposits to dissolve therein. The contact of the deposits with the composition can be accomplished in a variety of ways, e.g., the composition can be circulated over the deposits or the composition can be brought into contact with the deposits in a static state. Where small parts such as bearings, shafts, and the like are treated for the removal of deposits, the parts can simply be immersed in a composition of the present invention while agitating the composition for a period of time sufficient for the deposits to be dissolved in the composition.

As stated above, the methods and compositions of this invention are particularly suitable for removing deposits of cobalt (II or III) compounds from the exterior surfaces of cobalt (O) cemented tungsten carbide objects such as bearings, bearing parts and shafts. In carrying out the methods of the invention for removing deposits from such objects, the objects are immersed in the composition of the present invention for a short period of time whereby the deposits are dissolved therein. The composition rapidly dissolves the cobalt-containing deposits, such as oxides of cobalt, on the exterior surfaces of the objects but only slowly dissolves cobalt (O) in the cobalt-cemented tungsten carbide object. Thus, the objects can be immersed in the compositions of the present invention for a relatively short period of time, such as from about 5 to about 10 minutes, resulting in the cobalt-containing deposits being removed therefrom. After the cobalt-containing deposits on an object have been removed, in order to neutralize any deposit-removing composition remaining on the exterior surfaces of the object, the surfaces are contacted with an aqueous basic solution. Most preferably, the surfaces having the deposits removed therefrom are contacted with an aqueous solution of a carbonate base, preferably sodium bicarbonate.

The following examples are provided in order to facilitate a clear understanding of the methods and compositions of the present invention.

EXAMPLE 1

A composition of this invention comprised of an aqueous solution of ammonium thiocyanate at a concentration of 2.56 moles/liter and hydrochloric acid at a concentration of 0.43 moles/liter is prepared by dissolving 2 pounds of ammonium thiocyanate in one gallon of water and then combining 5.6 fluid ounces (165 milliliters) of concentrated (37.5% by weight) hydrochloric acid with the solution.

A portion of a rotor shaft formed of cobalt-cemented tungsten carbide measuring approximately ⅛ inch by ½ inch and having a cobalt containing deposit formed on the surfaces thereof is immersed in 3 milliliters of the composition for a period of 5 minutes at room temperature (about 25° C.). Upon removal from the cleaning composition, a visual examination of the shaft portion shows that the deposit is completely removed. Analysis of the cleaning solution shows it to contain 6.7 mpl of cobalt.

The cleaned shaft portion is then immersed in an additional 3 milliliters of fresh cleaning composition for 15 minutes at room temperature after which the composition is analyzed which shows it contains only 2.1 mpl of cobalt. Thus, the cobalt (II or III) deposits are rapidly removed by the cleaning composition, but cobalt (O) in the cobalt-cemented tungsten carbide material is only slowly leached from the material by the composition.

EXAMPLE 2

Turbine flow meters, equipped with cobalt-cemented tungsten carbide shafts and bearings, could not be properly calibrated and therefore experienced an unacceptably high rejection rate. Microscopic examination of the rejected flow meters revealed a water insoluble, varnish-looking coating on the surfaces of shafts and bearings.

It was determined, by energy dispersive X-ray, that the coating was a cobalt-containing compound.

The shafts and bearings from 20 of the defective flow meters were immersed in the composition of Example 1, above, for a period of 5 minutes with slight agitation at room temperature. The shafts and bearings were thereafter rinsed in a solution containing 0.5 pound of sodium bicarbonate per gallon of water.

The cleaned flow meters were again calibrated. Nineteen were successfully calibrated. The single meter which failed to properly calibrate had bent turbine blades.

What is claimed is:

1. A method of removing cobalt-containing deposits from surfaces comprising the step of contacting said deposits with a deposit removing composition for a period of time sufficient for said deposits to be dissolved therein, said composition being comprised of an aqueous acidic solution of a water soluble acid and a water soluble salt, the anionic portion of said salt being selected from the group consisting of cyano, thiocyanato, ferricyano, cyanato and mixtures thereof.

2. The method of claim 1 wherein the cationic portion of said salt is selected from alkali metal, alkaline earth metal, ammonium and mixtures thereof.

3. The method of claim 2 wherein said acid is selected from the group consisting of hydrochloric acid, sulfuric acid, nitric acid, acetic acid, formic acid and mixtures of such acids.

4. The method of claim 2 wherein said water soluble salt is present in said composition in an amount in the range of from about 0.005 to about 18 moles per liter of said acidic solution.

5. The method of claim 4 wherein said acid is present in said composition in an amount in the range of from about 0.005 to about 12 moles per liter of said acidic solution.

6. The method of claim 1 wherein said water soluble salt is a thiocyanate salt selected from the group consisting of ammonium, sodium and potassium thiocyanate and mixtures of such thiocyanates present in said composition in an amount in the range of from about 1.0 to about 3.0 moles per liter of said acidic solution.

7. The method of claim 6 wherein said acid is a mineral acid selected from the group consisting of hydrochloric acid, sulfuric acid and nitric acid and mixtures of such acids present in said composition in an amount in the range of from about 0.05 to about 1.0 moles per liter of said solution.

8. The method of claim 1 wherein said water soluble salt is ammonium thiocyanate present in said composition in an amount of about 2.56 moles per liter of said solution and said acid is hydrochloric acid present in said composition in an amount of about 0.43 moles per liter of said solution.

9. A method of removing deposits of cobalt compounds from the exterior surfaces of cobalt-cemented tungsten carbide objects comprising the steps of:

contacting said deposits with a composition capable of rapidly dissolving said deposits for a period of time sufficient for said deposits to be dissolved therein, said composition being comprised of an aqueous acidic solution of a water soluble acid and a water soluble salt, the anionic portion of said salt being selected from the group consisting of thiocyanato, ferricyano, cyano, cyanato and mixtures thereof;

contacting said surfaces with an aqueous solution containing a base to thereby neutralize said composition remaining on said surfaces.

10. The method of claim 9 wherein the cationic portion of said salt is selected from alkali metal, alkaline earth metal, ammonium and mixtures thereof.

11. The method of claim 10 wherein said acid is selected from the group consisting of hydrochloric acid, sulfuric acid, nitric acid, acetic acid, formic acid and mixtures of such acids.

12. The method of claim 10 wherein said water soluble salt is present in said composition in an amount in the range of from about 0.005 to about 18 moles per liter of said acidic solution.

13. The method of claim 12 wherein said acid is present in said composition in an amount in the range of from about 0.005 to about 12 moles per liter of said acidic solution.

14. The method of claim 9 wherein said water soluble salt is a thiocyanate salt selected from the group consisting of ammonium, sodium and potassium thiocyanate and mixtures of such thiocyanates present in said composition in an amount in the range of from about 1.0 to about 3.0 moles per liter of said acidic solution.

15. The method of claim 14 wherein said acid is a mineral acid selected from the group consisting of hydrochloric acid, sulfuric acid and nitric acid and mixtures of such acids present in said composition in an amount in the range of from about 0.05 to about 1.0 moles per liter of said solution.

16. The method of claim 9 wherein said water soluble salt is ammonium thiocyanate present in said composition in an amount of about 2.56 moles per liter of said solution and said acid is hydrochloric acid present in said composition in an amount of about 0.43 moles per liter of said solution.

17. The method of claim 16 wherein said base is a water soluble carbonate salt.

18. The method of claim 17 wherein said base is sodium bicarbonate.

19. A composition for dissolving cobalt (II or III) compounds comprising an aqueous acidic solution of a water soluble acid and a water soluble thiocyanate salt.

20. The composition of claim 19 wherein said acid is selected from the group consisting of hydrochloric acid, sulfuric acid, nitric acid, acetic acid, formic acid and mixtures of such acids.

21. The composition of claim 19 wherein said thiocyanate salt is present in said composition in an amount in the range of from about 0.005 to about 18 moles per liter of said acidic solution.

22. The composition of claim 21 wherein said acid is present in said composition in an amount in the range of from about 0.005 to about 12 moles per liter of said acidic solution.

23. The composition of claim 19 wherein said thiocyanate salt is selected from the group consisting of ammonium, sodium and potassium thiocyanate and mixtures of such thiocyanates present in said composition in an amount in the range of from about 1.0 to about 3.0 moles per liter of said acidic solution.

24. The composition of claim 23 wherein said acid is a mineral acid selected from the group consisting of hydrochloric acid, sulfuric acid, nitric acid and mixtures of such acids present in said composition in an amount in the range of from about 0.05 to about 1.0 moles per liter of said solution.

25. The composition of claim 19 wherein said thiocyanate salt is ammonium thiocyanate present in said composition in an amount of about 2.56 moles per liter of said solution and said acid is hydrochloric acid present in said composition in an amount of about 0.43 moles per liter of said solution.

* * * * *